US007611114B1

(12) United States Patent
Griffin

(10) Patent No.: US 7,611,114 B1
(45) Date of Patent: Nov. 3, 2009

(54) PORTABLE MUSIC PLAYER HOLDER

(75) Inventor: Paul Griffin, Nashville, TN (US)

(73) Assignee: Griffin Technology, Inc., Nashville, TN (US)

( * ) Notice: Subject to any disclaimer, the term of this patent is extended or adjusted under 35 U.S.C. 154(b) by 0 days.

(21) Appl. No.: 11/213,485

(22) Filed: Aug. 26, 2005

(51) Int. Cl.
*A47K 1/08* (2006.01)

(52) U.S. Cl. ..... 248/311.2; 248/314; 248/309.1; 224/926; 202/737; 379/445; 455/90.3

(58) Field of Classification Search ..... 248/311.2, 248/314, 309.1, 310, 315; 224/926; 202/737; 379/446, 455, 454; 455/90.3; 244/544, 929, 244/539, 542, 545, 555, 556, 564, 565, 566, 244/567, 568
See application file for complete search history.

(56) References Cited

U.S. PATENT DOCUMENTS

D289,898 S * 5/1987 Miller ..... D14/250
4,974,741 A * 12/1990 Gustafson et al. ..... 220/739
5,745,465 A * 4/1998 Tsai et al. ..... 369/112.17
5,897,041 A * 4/1999 Ney et al. ..... 224/483
6,315,153 B1 * 11/2001 Osborn ..... 220/737
6,361,009 B1 * 3/2002 Li ..... 248/311.2
6,396,925 B1 * 5/2002 Close ..... 379/446
D478,741 S * 8/2003 White ..... D6/467
6,641,102 B2 * 11/2003 Veltri et al. ..... 248/311.2
6,738,477 B1 * 5/2004 Kam ..... 379/446
7,040,590 B2 * 5/2006 Carnevali ..... 248/311.2
7,099,467 B1 * 8/2006 Rohrbach ..... 379/446
2002/0049081 A1 * 4/2002 Heininger ..... 455/575
2004/0086112 A1 * 5/2004 Hilger et al. ..... 379/455
2004/0213405 A1 * 10/2004 Wilcox ..... 379/455

* cited by examiner

*Primary Examiner*—Kimberly T Wood
(74) *Attorney, Agent, or Firm*—Hornkohl Intellectual Property Law PLLC; Jason L. Hornkohl

(57) ABSTRACT

A holder for a digital audio player such as an Apple iPOD™ is designed to fit in a standard sized cup holder. The holder is configured to support the digital audio player at an easy to read angle and provides a slot for a cable such as a power cable to extend from the holder. The holder is constructed from relatively soft compressible foam that conforms to different sized cup holders and protects the digital audio player from damage. A plurality of support portions allows the holder to support various size digital audio players.

12 Claims, 2 Drawing Sheets

PORTABLE MUSIC PLAYER HOLDER

CROSS-REFERENCES TO RELATED APPLICATIONS

Not Applicable

STATEMENT REGARDING FEDERALLY SPONSORED RESEARCH OR DEVELOPMENT

Not Applicable

REFERENCE TO SEQUENCE LISTING OR COMPUTER PROGRAM LISTING APPENDIX

Not Applicable

BACKGROUND OF THE INVENTION

The present invention relates generally to the field of mp3 player accessories. More particularly, the present invention relates to a novel holder for an mp3 player.

Mp3 players are increasingly popular devices that are used to play music. As a result of their popularity, numerous accessories have been created for mp3 players. For example, FM transmitters have been designed that allow an mp3 player to broadcast signals to a standard FM car radio such that the music played by the mp3 player can be listened to on the car stereo's speakers. Thus, many users prefer to use their mp3 player over their car radio because their car radio may not support mp3 files and can not be taken with them when the car ride is over. Unfortunately, it is often difficult to position the mp3 player in the automobile such that it will not be in the way, fall or be damaged. In addition, mp3 players are often used when seated in a chair or at a desk or table where there may not be a convenient and secure location to place the mp3 player. Therefore, what is needed is an improved device for securely holding an mp3 player in a vehicle.

BRIEF SUMMARY OF THE INVENTION

An embodiment of the present invention is directed toward a holder for a digital music player. The holder includes a base shaped to be received by a cup holder. The base has an upper portion adapted to securely hold the digital music player. The upper portion holds the digital music player at an angle that allows a display of the digital music player to be easily viewed. The upper portion also includes a cable attachment cavity that provides room for a cable to be attached to the digital music player. The holder includes at least one cable slot such that a cable attached to the digital music player can extend outward from the holder. The holder is constructed from compressible foam such that the base can conform to different sized cup holders and does not scratch the digital audio player. The holder preferably has at least two digital audio player receiving sections designed to receive one of a least two different sizes of digital audio players.

Another embodiment of the present invention is directed toward an insert for a cup holder. The insert includes a digital audio player mounting portion for receiving and holding a digital audio player. The mounting portion is adapted to hold the digital audio player at an angle such that a display of the digital audio player is easily visible. The insert is constructed from compressible foam that conforms to an inner dimension of the cup holder and allows it to adapt to various size cup holders. The insert has protrusions adapted to prevent the insert from easily turning when positioned in the cup holder.

The insert has a cable receiving portion that is adapted to receive a cable extending from the digital audio player.

Yet another embodiment of the present invention is directed toward a holder for a digital audio player wherein the holder has a base that is adapted to be received by a cup holder. The holder has a digital audio player receiving section that is designed to support the digital audio player such that a display of the digital audio player is visible and a set of function key are accessible. The holder is constructed from a compressible material that is adapted to conform to various size cup holders. The holder has a hole in a base portion. A cable receiving portion allows an input cable to extend from the digital audio player when the digital audio player is positioned in the holder. The cable receiving portion includes at least one cable slot. The holder includes at least two player supports for receiving and supporting one of at least two different digital audio player configurations.

DETAILED DESCRIPTION OF THE INVENTION

Figure 1:
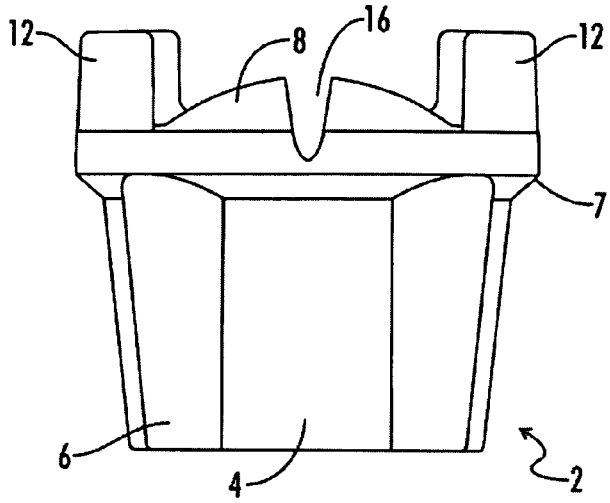
FIG. 1 is a three dimensional illustration of a frontal view of an embodiment of the present invention.
Figure 2:
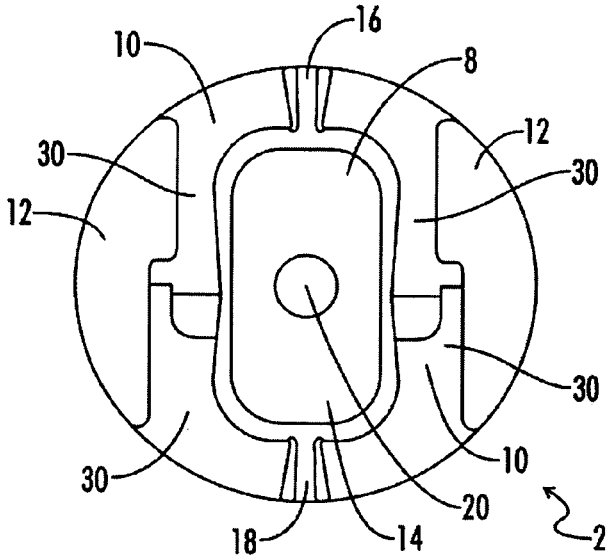
FIG. 2 is a three dimension illustration of a top view of an embodiment of the present invention.

Referring now to FIGS. 1 and 2, an embodiment of the portable music player holder 2 of the present invention is shown. The portable music player holder 2 has a base 4 that is designed to rest securely in a cup holder. Accordingly, the base 4 is designed to approximate the bottom of a standard sized cup. Most preferably, the holder has a base 4 that is approximately 2.5 inches in diameter that slightly expands towards the top. The cup holder adapter 2 is preferably constructed from a material such as compressible foam that allows it to conform to most standard sizes and configurations of cup holders and securely holds the adapter in the cup holder. In addition, a relatively soft material such as compressible foam won't scratch or harm the exterior of a portable music player inserted into the player cavity. The use of soft, compressible foam also cushions any shocks imparted from a moving vehicle to the mp3 player and, thus, minimizes the likelihood that any such shocks will damage the player. In addition, four equally spaced elongate protrusions 6 running upward from the base 4 are provided that prevent the holder 2 from easily turning when placed in a cup holder. While the protrusion 6 configuration shown in FIG. 1 is preferred, it will readily be appreciated by those skilled in the art that a wide variety of protrusion 6 configurations could be utilized to fix the holder 2 in a cup holder.

The player cavity 8 holds the mp3 player at an easy to see angle, most preferably 35 degrees, that allows the player's display to be read and the player's function keys to accessed and manipulated with the mp3 player is resisting in the adapter 2. Two different sized cavities 10 are provided in the player cavity 8 and the upper raised portions 12 of the holder 2. Each cavity 10 is formed with inclined sidewalls 30 which are adapted to receive different sized mp3 players and hold them at the desired angle. The embodiment shown in FIGS. 1 and 2 has cavities 10 with inclined sidewalls 30 and upper raised portions 12 that are specifically dimensioned to receive Apple Computer, Inc.'s iPOD™ and iPOD mini. However, it will be appreciated that the cavities 10 and upper raised portions 12 of the adapter 2 can be dimensioned to receive almost any desired player.

A cable attachment cavity 14 provides room inside of the player cavity 8 for a docking connector to attach to an mp3 player placed in the player cavity 8. A pair of cable slots 16 and 18 allow a cable to easily extend from the docking connector attached to an mp3 player placed in the player cavity 14 to an exterior connection. Thus, the cable cavity 14 and cable slots 16 and 18 allow the mp3 player to be recharged by a charger or connected to an accessory while being securely held by the holder 2. A lip 7 protrudes from the upper portion of the base 4 to prevent the cup holder adapter 2 from sliding through an open bottomed cup holder. While the preferred configuration of the lip 7 is shown in the figures, it will be readily appreciated by those skilled in the art that a wide variety of different lip 7 configurations could be utilized in various embodiments constructed in accordance with the present invention.

A hole 20 is preferably positioned in the bottom of the player cavity 8 to allow air to escape when the holder 2 is placed in a tight fitting cup holder. In addition, the hole 20 may permit any liquid accidentally introduced into the holder 2 to drain away without damaging the mp3 player.

Figure 3:
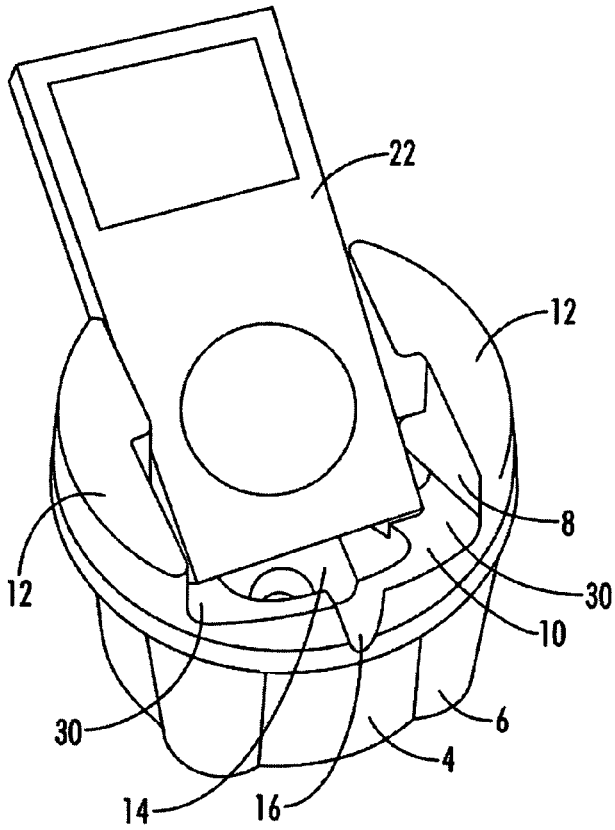
FIG. 3 is a three dimensional illustration of an embodiment of the present invention holding an mp3 player while positioned in a cup holder.

FIG. 3 illustrates the embodiment of FIGS. 1 and 2 with an mp3 player 22 positioned in the player cavity 8.

Although particular embodiments of the present invention of a new and useful Portable Music Player Holder have been described herein, it is not intended that such references be construed as limitations upon the scope of the invention except as set forth in the following claims.

What is claimed is:

1. A holder for a portable electronic device, said holder comprising:

a substantially circular base shaped to be received by a cup holder;

an upper portion having a first cavity formed therein wherein said first cavity has a substantially rectangular cross section and two substantially parallel sidewalls inclined with respect to an exterior sidewall of said substantially circular base and wherein an uppermost edge of said first cavity extends along an exterior of said upper portion and said substantially parallel sidewalls extend downward from said upper most edge to a lowermost edge of said first cavity and said lowermost edge is above said substantially circular base;

a second cavity in said upper portion that intersects said first cavity wherein said second cavity has two substantially parallel sidewalls inclined with respect to said exterior sidewall of said substantially circular base and wherein an uppermost edge of said second cavity extends along an exterior of said upper portion opposite said uppermost edge of said first cavity and said substantially parallel sidewalls extend downward from said upper most edge to a lowermost edge of said second cavity and said lowermost edge is above said substantially circular base;

wherein each of said uppermost edges of said first and second cavities has a slot formed therein that is dimensioned to receive a cable connected to said electronic device when said electronic device is mounted in said cavity.

2. The holder of claim 1 wherein a distance measured between said substantially parallel sidewalls of said first cavity is greater than a distance between said substantially parallel sidewalls of said second cavity.

3. The holder of claim 1 wherein an angle of inclination of said substantially parallel sidewalls of said first cavity is approximately equal to an angle of inclination of said substantially parallel sidewalls of said second cavity.

4. The holder of claim 1 further comprising two raised portions on said exterior of said upper portion wherein said two raised portions are positioned between said uppermost edge of said first cavity and said uppermost edge of said second cavity.

5. The holder of claim 1 further comprising a cable attachment cavity formed in said substantially circular base wherein said cable attachment cavity divides said lower most edges of said first and second cavities and a width of said attachment cavity is less than a width of either of said lowermost edges.

6. The holder of claim 5 wherein said cable attachment cavity further comprises an opening positioned in a bottom of said cable attachment cavity and said substantially circular base.

7. A holder for a portable electronic device, said holder comprising:

a substantially circular base shaped to be received by a cup holder;

an upper portion having a first cavity formed therein wherein said first cavity has two substantially parallel sidewalls inclined with respect to an exterior sidewall of said upper portion and wherein an uppermost edge of said cavity extends along an exterior of said upper portion and said substantially parallel sidewalls extend downward from said upper most edge to a lowermost edge of said first cavity positioned above said substantially circular base;

a second cavity wherein said second cavity has two substantially parallel sidewalls inclined with respect to said exterior sidewall of said upper portion and wherein an uppermost edge of said second cavity extends alone an exterior of said upper portion opposite said uppermost edge of said first cavity and said substantially parallel sidewalls extend downward from said upper most edge to a lowermost edge of said second cavity in said substantially circular base; and two raised portions formed on said exterior of said upper portion wherein said two raised portions are positioned between said uppermost edge of said first cavity and said uppermost edge of said second cavity.

8. The holder of claim 7 wherein said upper most edge has a slot formed therein that is dimensioned to receive a cable connected to said electronic device when said electronic device is mounted in said first cavity.

9. The holder of claim 7 wherein a distance measured between said substantially parallel sidewalls of said first cavity is greater than a distance between said substantially parallel sidewalls of said second cavity.

10. The holder of claim 7 wherein an angle of inclination of said substantially parallel sidewalls of said first cavity is approximately equal to an angle of inclination of said substantially parallel sidewalls of said second cavity.

11. The holder of claim 7 further comprising a cable attachment cavity formed in said substantially circular base wherein said cable attachment cavity divides said lower most edge of said first cavity and a width of said cable attachment cavity is less than a width of said lowermost edge.

12. The holder of claim 11 wherein said cable attachment cavity further comprises an opening positioned in a bottom of said cable attachment cavity and said substantially circular base.

* * * * *